United States Patent [19]

Bonny et al.

[11] 4,431,491

[45] Feb. 14, 1984

[54] PROCESS AND APPARATUS FOR ACCURATELY CONTROLLING THE RATE OF INTRODUCTION AND THE CONTENT OF ALUMINA IN AN IGNEOUS ELECTROLYSIS TANK IN THE PRODUCTION OF ALUMINIUM

[75] Inventors: Paul Bonny; Jean-Louis Gerphagnon, both of St. Jean de Maurienne; Gérard Laboure, Albertville; Maurice Keinborg, St. Jean de Maurienne, all of France; Pierre Homsi, Sydney, Australia; Bernard Langon, St. Jean de Maurienne, France

[73] Assignee: Pechiney, France

[21] Appl. No.: 284,812

[22] Filed: Jul. 20, 1981

[30] Foreign Application Priority Data

Jul. 23, 1980 [FR] France ..... 80 16406

[51] Int. Cl.[3] ..... C25C 3/06; C25C 3/14; C25C 3/20

[52] U.S. Cl. ..... 204/67; 204/245

[58] Field of Search ..... 204/67, 245

[56] References Cited

U.S. PATENT DOCUMENTS 3,622,475 11/1971 Shiver et al. ..... 204/67

4,126,525 11/1978 Wakaizumi et al. ..... 204/67

*Primary Examiner*—Howard S. Williams

*Attorney, Agent, or Firm*—McDougall, Hersh & Scott

[57] ABSTRACT

A process and apparatus for controlling the rate of introduction and the content of alumina to a tank for the production of aluminium by the electrolysis of dissolved alumina in a cryolite-base bath, the upper part of which forms a solidified crust, and wherein the alumina content is maintained within a narrow range, of between 1% and 3.5%, wherein the alumina is introduced directly into the molten cryolite bath by way of at least one opening which is kept open in the solidified crust and the rate at which the alumina is introduced is modulated relative to variations in the internal resistance of the tank during predetermined periods of time, with alternation of the cycles of introducing alumina at a slower rate and at a faster rate than the rate corresponding to normal consumption within the tank.

17 Claims, 5 Drawing Figures

PROCESS AND APPARATUS FOR ACCURATELY CONTROLLING THE RATE OF INTRODUCTION AND THE CONTENT OF ALUMINA IN AN IGNEOUS ELECTROLYSIS TANK IN THE PRODUCTION OF ALUMINIUM

BACKGROUND OF THE INVENTION

The present invention concerns a process and apparatus for accurately controlling the rate of introduction and the content of alumina in an igneous electrolysis tank, and the use thereof for the production of aluminium using the Hall-Heroult process.

In recent years, operation of aluminium production tanks has been progressively automated, both in order to improve the power balance sheet and operating regularity thereof and also to limit the extent of human involvement and improve the efficiency in collecting the fluorinated effluents.

One of the essential factors in regard to ensuring operating regularity of a tank for the production of aluminium by the electrolysis of alumina dissolved in molten cryolite is the rate of introduction of the alumina into the bath. An alumina deficiency causes the occurrence of the 'anodic effect' or 'racing' phenomenon, which causes an abrupt increase in the voltage at the terminals of the tank, which can go from 4 to 30 or 40 volts, and which has repercussions on the entire production process.

An excess of alumina gives rise to the danger of the bottom of the tank being fouled by alumina deposits which may be converted into hard plates which electrically insulate a part of the cathode. This induces the generation of very strong horizontal currents in the metal of the tanks. By interaction with the magnetic fields, such currents agitate the layer of metal and cause instability at bath-metal interface.

This defect is particularly troublesome when it is desired to lower the operating temperature of the tank, which is highly advantageous in regard to the level of Faraday efficiency, by adopting highly 'acid' baths (with a high $AlF_3$ content) or baths which include various additives such as lithium or magnesium salts or chlorides. However, these baths suffer from a substantially reduced capacity and alumina dissolution speed, and the use thereof involves very accurately controlling the alumina content, to relatively low levels of concentration and between two relatively close limit values.

Although it is possible for the alumina content of the baths to be measured directly by analyzing samples of electrolyte, for many years now the method selected has been to effect indirect evaluation of the alumina content by following an electrical parameter which reflects the concentration of alumina in the electrolyte.

This parameter is generally the variation in internal resistance or, more precisely, the internal pseudo-resistance which is equal to:

$$R = \frac{U - e}{I}$$

in which e is an image of the back e.m.f. of the tank, whereby it is generally accepted that it is 1.65 volts, U is the voltage at the terminals of the tank, and I is the amperage of the current passing therethrough.

By taking a series of readings, it is possible to trace a curve showing the variation in R relative to the alumina content, and by measuring R at a given frequency, using methods which are well known at the present time, it is possible at any moment to ascertain the level of concentration as symbolically represented by $[Al_2O_3]$.

For many years now, attempts have been made to introduce alumina into the bath with a certain degree of regularity so as to maintain the level of concentration thereof relatively stable about a predetermined value.

Processes for the automatic feeding of alumina, which are controlled more or less strictly relative to the concentration of alumina in the bath, have been described in particular in the following patents: French patent No. 1 457 746 to Reynolds, wherein the variation in internal resistance of the tank is used as a parameter reflecting the level of concentration of alumina, which is introduced into the bath by means of a distributor combined with a means for making a hole in the crust of solidified electrolyte; French patent No. 1 506 463 to V.A.W. which is based on measuring the time which elapses between stopping the feed of alumina and the occurrence of the anodic effect; U.S. Pat. No. 3,400,062 assigned to ALCOA which uses a 'pilot anode' in order to achieve advance detection of 'racing' and control the rate of introduction of the alumina which is distributed from a hopper provided with a means for making a hole in the crust of solidified electrolyte.

The alumina feed means is described in greater detail in U.S. Pat. No. 3,681,229 which is also assigned to ALCOA.

More recently, control processes based on monitoring the alumina content have been described in particular in Japanese patent application No. 52-28417/77 to SHOWA DENKO, and in U.S. Pat. No. 4,126,525 assigned to MITSUBISHI.

In the first of these patents, the level of concentration of alumina is fixed in the range of from 2 to 8%. The variation $\Delta V$ in dependence on time t, in the voltage at the terminals of each tank is measured, and is compared to a predetermined value. The rate at which alumina is introduced is modified to adjust the $\Delta V/T$ to the standard value. The disadvantage of this process is that the sensitivity thereof varies with the alumina content which is actually at a minimum in the range used, from 3 to 5% of $Al_2O_3$ (see the Table on page 84).

In the second of these patents, the alumina content is also fixed in the range of from 2 to 8% and preferably from 4 to 6%. The tank is supplied for a predetermined period of time $t_1$, with an amount of alumina which is higher than the theoretical consumption thereof, until a predetermined level of concentration of alumina is obtained (for example up to 7%), then the feed is switched over to a rate equal to the theoretical consumption, for a predetermined period of time $t_2$, the feed is then stopped until the initial symptoms of anodic effect ('racing') appear, and the feed cycle is resumed at a rate which is higher than the theoretical consumption.

In this process, the concentration of alumina varies from 4.9 to 8% (Example 1) or from 4.0 to 7% (Example 2), in the course of the cycle.

These different processes lack accuracy and do not solve the problem set, which is that of controlling the content of alumina between narrow limits.

SUMMARY OF THE INVENTION

The present invention concerns a process for accurately controlling the rate of introduction and the content of alumina in a tank for the production of aluminium by the electrolysis of alumina in a molten cryolite-base bath, the upper part of which forms a solidified crust. The process ensures that the alumina content is maintained in a narrow range selected at between 1 and 3.5%, and comprises introducing the alumina directly into the molten cryolite bath in successive amounts, of substantially constant weight and at variable periods of time, by way of at least one opening which is kept permanently open in the solidified crust, and modulating the rate of introduction of the alumina in dependence on the variations in the internal pseudo-resistance of the tank in predetermined periods of time, with alternation of the phases of under-feed and over-feed of alumina with respect to the rate corresponding to the consumption of the tank.

The invention also relates to an apparatus for carrying out the process for accurately controlling the content of alumina, comprising means for delivering to each opening successive amounts of alumina, of substantially constant weight, means for measuring the internal pseudo-resistance, means for calculating the speed of variation of the internal resistance, means for varying the rate of introduction of the amounts of alumina in dependence on the variations in the internal resistance, and means for varying the anode-cathode distance of the tank.

The invention also concerns the use of the above-defined process and apparatus for the production of aluminium by means of the Hall-Heroult process either with a normal or slightly acid electrolyte, based on cryolite, which may also contain from 5 to 13% of $AlF_3$ and which operates in the region of 955° to 970° C., or with a highly acidic electrolyte which may contain from 13 to 20% of $AlF_3$ and which operates in the region of 930° to 955° C. and which may also contain lithium in the form of LiF and operates at temperatures which may be down to 910° C.

DETAILED DESCRIPTION OF THE INVENTION

Figure 1:
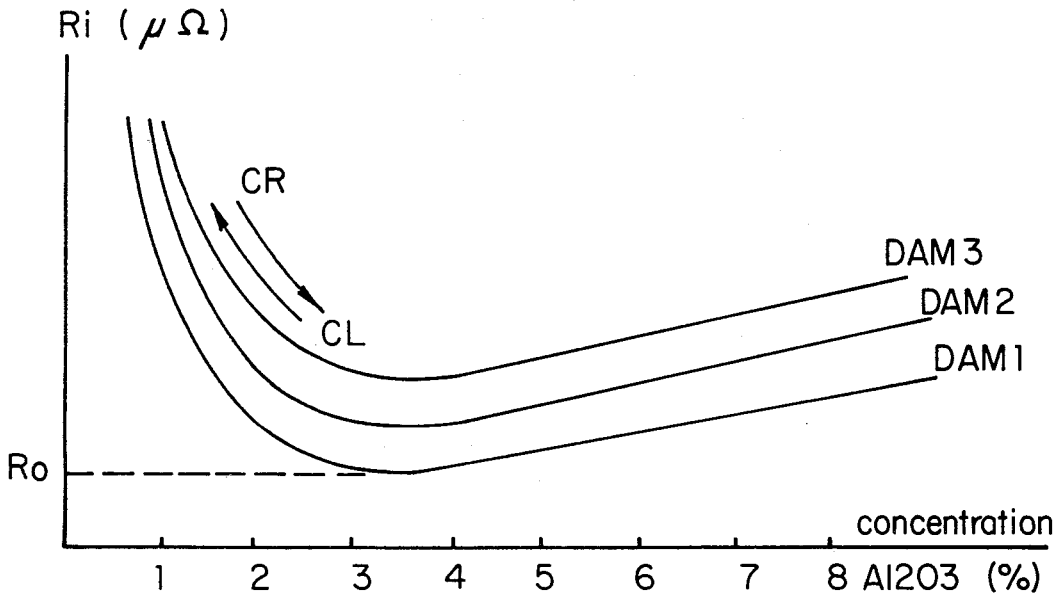
FIG. 1 shows the variation in internal pseudo-resistance of an electrolysis tank in dependence on its alumina content, with the anode-cathode distance 'DAM', as a parameter.

FIG. 1 shows that the internal pseudo-resistance of a tank passes through a minimum in the region of 3.5 to 4% and rapidly increases on the side of low levels of alumina content and increases much more slowly on the side of high levels of alumina content. Therefore, in order to achieve a good level of sensitivity, it is advantageous to operate on the side of low levels of alumina content, but without going below 1%, about which value the internal pseudo-resistance increases very rapidly when the alumina content falls, which corresponds to the anodic effect or 'racing'. Hereinafter, for the sake of simplicity, we shall refer to the internal resistance denoted by Ri in order to denote the internal pseudo-resistance.

The invention is based on using the part of the curve $Ri=f\ [Al_2O_3]$ which is between alumina contents of from 1 to 3.5% approximately, and the possibility of evaluating at any moment, and correcting, the alumina content of the cryolite bath, and keeping it between very close limits. Besides a very high degree of operating reliability, this results in the possibility of using electrolysis baths which have a lower capacity for absorption of alumina but which on the other hand result in a substantially reduced operating temperature and a substantially increased level of current efficiency, referred to as the Faraday efficiency.

The process according to this invention, which comprises modulating the rate of feed in dependence on the variations in internal resistance, comprises the following successive stages (identical stages, in the various alternative forms of the process, will be denoted by the same reference letters).

A: a reference value Ro is fixed relative to the internal resistance Ri, which is for example 13.9$\mu\Omega$ for a modern 175000 ampere tank with pre-baked anodes, and two upper and lower limit values between which the internal resistance will be allowed to vary, namely Ro+r and Ro−r, for example 13.9±0.1$\mu\Omega$.

B: a control cycle is begun at the moment at which Ri is between 13.8 and 14.0$\mu\Omega$.

Figure 2:
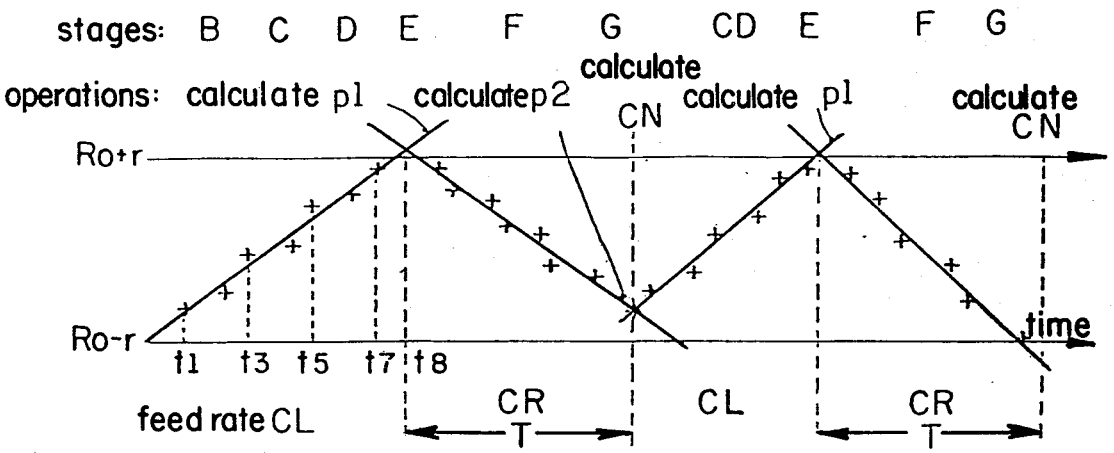
FIG. 2 shows the variation in the internal pseudo-resistance of an electrolysis tank in dependence on time and the rate of introduction of alumina, in accordance with the invention.
Figure 3:
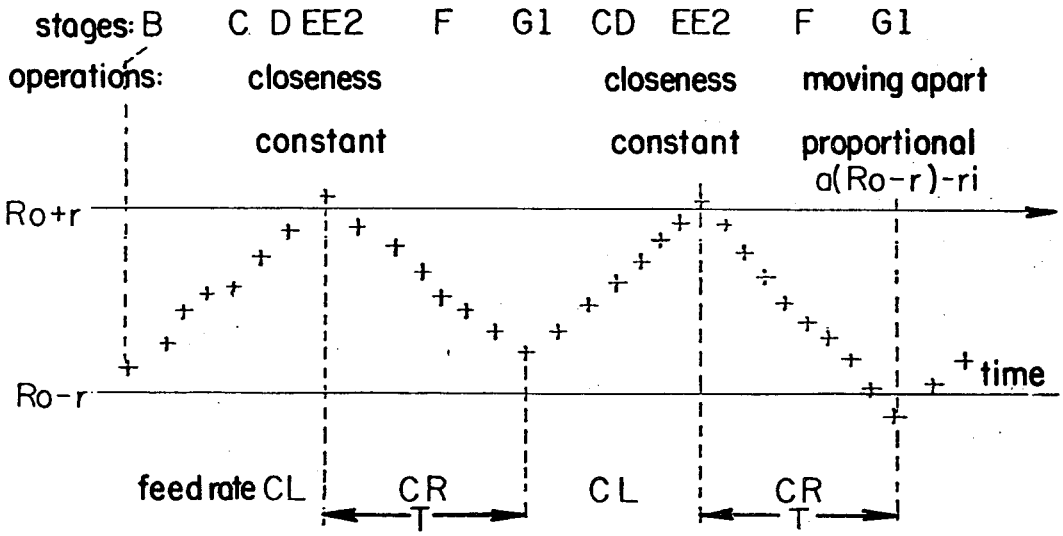
FIG. 3 shows the variation in the internal pseudo-resistance of an electrolysis tank in dependence on time and the rate of introduction of the alumina, in accordance with an alternative form of carrying the invention into effect.

C: the tank is fed at a rate referred to as a low rate (which will be denoted as CL) being from 15 to 50% below the normal rate of consumption corresponding to the electrolysis process, which will be denoted as CN (over a long period of time, CN is approximately of the order of 100 kg/h for a 175000 ampere tank). CL is deduced from CN by the equation $CL=\alpha.CN$ in which $\alpha$ is an adjustable parameter. The tank will therefore have a progressive fall in its alumina content, the figurative point will rise in the direction of the arrow CL in FIG. 1, and Ri will increase (FIG. 2).

D: measurements are taken of the successive values assumed by the internal resistance at equal periods of time $t_1$, $t_2$, $t_3$, etc, for example every 3 to 6 minutes. In practice, a large number of measurements are made, and the average thereof is taken, so as to eliminate the danger of aberrant values.

E: the slope $p_1$ of the curve, which in practice can be assimilated to a straight line, relative to the variation in internal resistance in dependence on time in the course of stage D is determined. If the slope $p_1$ is less than a reference value $p^o_1$, an order for 'closing up' is given, that is to say, an order for reducing the anode-cathode distance or, more precisely, the distance between the metal and the anodes (DAM) by downward movement of the anodic system by a predetermined value. When the internal resistance exceeds the upper limit value Ro+r (at $t_8$ for example), the feed device is so controlled as to go to the rapid rate (CR) which is 20 to 100% higher than the normal consumption CN for a predetermined period of time T which may be of the order of half an hour to one hour. CR is deduced from CN by the equation $CR=\beta.CN$ in which $\beta$ is an adjustable parameter.

F: because of the rapid-rate feed, the alumina content of the tank will progressively increase since it is being supplied with more than the amount consumed by electrolysis, the figurative point will move down again in the direction indicated by arrow CR in FIG. 1 and Ri will fall. Measurements are taken of the successive values assumed by the internal resistance, at equal periods of time, $t_9$ and $t_{16}$, for example, every 3 to 6 minutes.

G: at the end of the time T, the rapid-rate feed is stopped. The slope $p_2$ relative to the variation in internal resistance in dependence on time during stage F is calculated, and the following operations are performed:

(a) $p_2$ and $p_1$ are compared. They must be in the ratio:

$$\frac{p_2}{p_1} = \frac{CN - CR}{CN - CL}$$

If this is not the case, it is deduced therefrom that CN is poorly centered and a fresh value $CN_1$ is re-calculated, in accordance with the following equation:

$$CN_1 = \frac{p_2 - p_1}{\frac{p_2}{CL} - \frac{p_1}{CR}}$$

(p is in $\mu\Omega$/min and CL is for example in kg/min).

This calculation is normally carried out by the automatic system which pilots the tank and the operation of resetting CN is automatic, these operations being performed by equipment known to those skilled in the art, which is not part of the present invention;

(b) If Ri has fallen below Ro−r or if $p_2$ is higher than a reference value $p^o_2$, an order for moving apart is given, that is to say, an order for increasing the anode-cathode distance, by a predetermined amount;

(c) the feed is switched to a slow rate, which is possibly modified in dependence on the fresh value of $CN_1$ of the normal rate, and a fresh cycle is thus resumed at stage C.

In the process, the time T (of rapid-rate feed) and the rapid rate CR are so adjusted that the level of concentration of alumina in the electrolyte rises by from 0.5 to 1% (relative to the absolute value) and preferably 0.5 to 0.6%. Operation is therefore shifted on to a reduced portion of the curve Ri=f $[Al_2O_3]$ which can accordingly, and without significant error, be considered as linear in the region involved.

This process therefore provides a very high degree of accuracy in regard to the alumina content and consequently a very high degree of regularity in operating the tank.

The process may be used in two alternative forms, which are simpler to perform; first alternative: stages A to D are carried out and then:

$E_1$: when the internal resistance Ri has crossed the upper limit value Ro+r, the tank is given an order to 'close up' by a predetermined amount, and the feed rate goes to the rapid rate CR for a predetermined time T.

F: because the feed is at the rapid rate, the alumina content of the tank will progressively increase since it is supplied with more than the amount consumed by the electrolysis operation, the figurative point will move down again in the direction indicated by arrow CR in FIG. 1 and Ri will fall.

Measurements are taken of the successive values assumed by the internal resistance, at equal periods of time, $t_9$ to $t_{16}$, for example every 3 to 6 minutes.

$G_1$: when the time T has elapsed, the feed goes back to a slow rate. If, at the end of the period of time T, Ri<Ro−r, an order for moving apart in proportion to the difference (Ro−r)−Ri is given, so as to reset the beginning of the cycle, with Ri substantially equal to Ro−r.

In this alternative form, there is no longer any calculation in respect of the slopes $p_1$ and $p_2$, and accordingly there is no longer the information 'corrected normal rate $CN_1$'.

A second alternative comprises carrying out stages A to E as just described above, and then continuing in the following manner:

$E_2$: when the internal resistance Ri has crossed the upper limit value Ro+r, the tank is given an order to 'close up' by a predetermined amount. If such closing-up adjusts the following value of Ri to below Ro+r, the feed is continued at a slow rate until Ri again goes above Ro+r. A new order to 'close up' is then given. If the first 'close-up' order has not permitted the following value Ri to fall again to below Ro+r, a second close-up order, and possibly further close-up orders are given, but the maximum number N of successive orders, beyond which the feed returns to the rapid rate, has been fixed a priori, and introduced into the automatic system. The above-indicated number N may be 1, 2, 3, 4 or 5 (if N is equal to 0, this involves returning to the previous case, stage $E_1$). The feed then goes to the rapid rate CR for a predetermined period of time T.

F: because of the rapid-rate feed, the alumina content of the tank will progressively increase since it is being supplied with more than the amount consumed by electrolysis, the figurative point will move down again in the direction indicated by arrow CR in FIG. 1, and Ri will fall.

$G_1$: when the time T has elapsed, the feed goes back to the slow rate CL. If, at the end of the period of time T, Ri<Ro−r, an order for moving apart in proportion to the difference (Ro−r)−Ri is given, so as to reset the beginning of the cycle with Ri substantially equal to Ro−r.

The apparatus for carrying out the invention comprises, firstly, a means for supplying to each introduction opening formed in the crust of solidified electrolyte, successive amounts of alumina, of substantially constant weight, combined with a means for storing the alumina, which is preferably located in the vicinity of the tank and which may be periodically re-filled from a central storage location.

Figure 4:
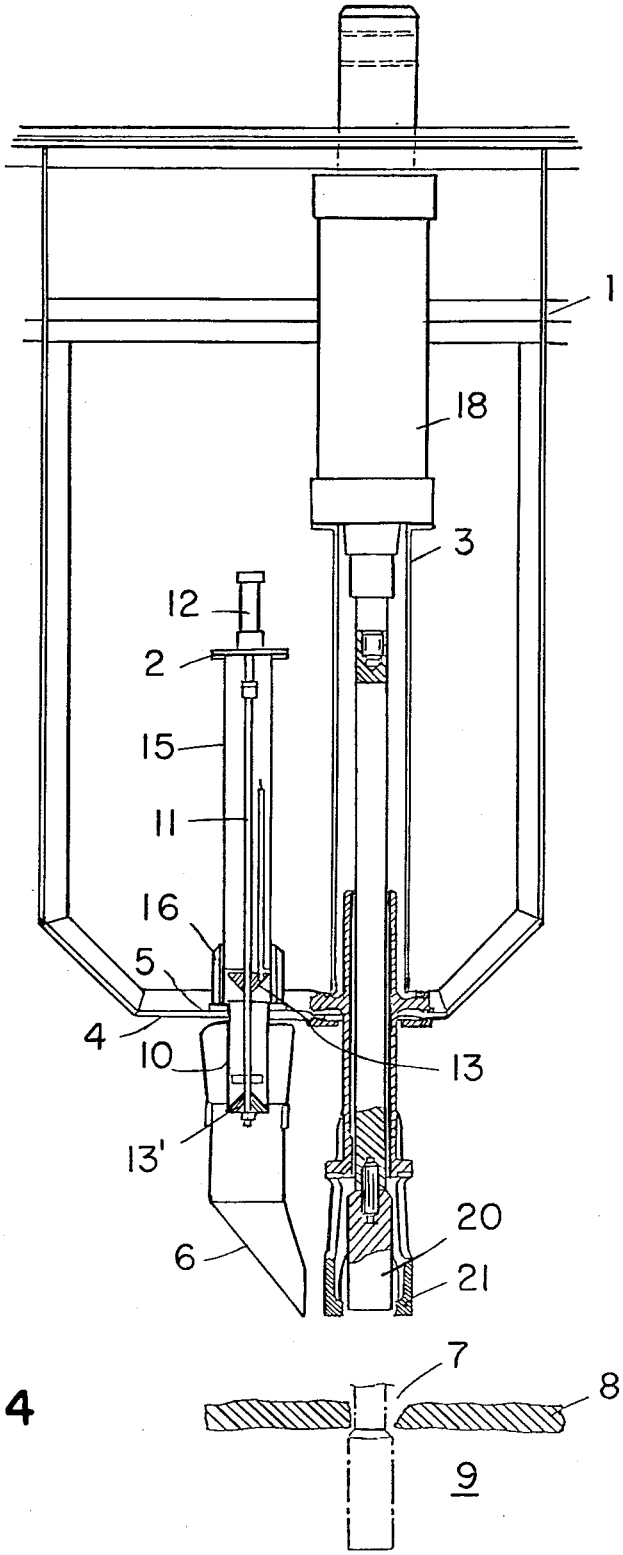
FIG. 4 shows an assembly comprising a metering means, its feed hopper, and a device for holding the opening for introducing the alumina in a permanently open condition.
Figure 5:
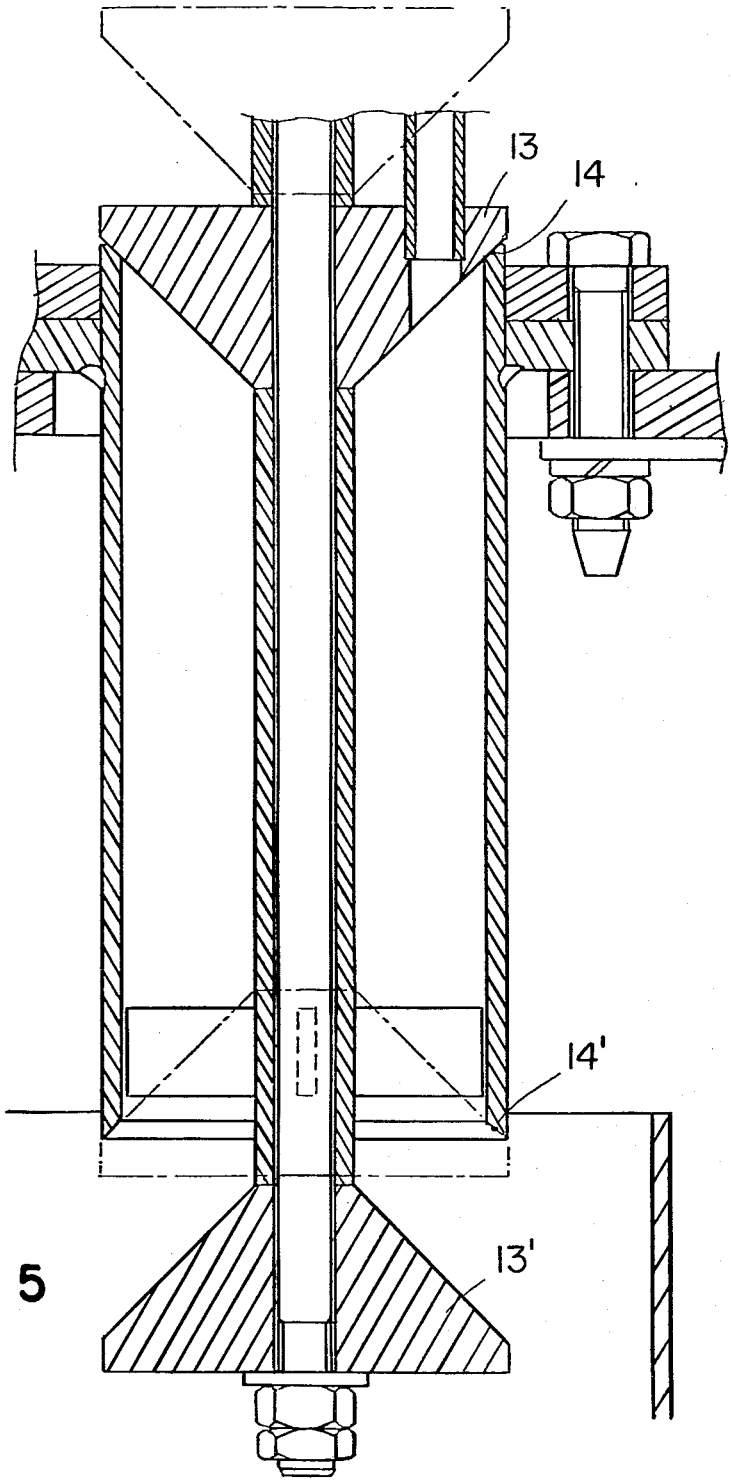
FIG. 5 shows the metering means for supplying successive amounts of alumina, of substantially constant weight.

FIGS. 4 and 5 show an alumina feed device according to the invention.

The alumina is stored in the hopper 1 which is disposed in the superstructure of the tank. The capacity of the hopper may correspond for example to one or more days of operation, and it is re-filled from a centralized storage location, by any known means (pneumatic, fluidized, etc . . . conveyor means).

The distributor 2 and the piercing tool 3 are disposed actually within the hopper and fixed to a plate 4 which forms the bottom thereof. The distributor essentially comprises a metering means 5 and a distributor 6 which introduces the alumina into the opening 7 which is formed and maintained in the solidified crust 8 at the surface of the electrolyte 9.

The metering means 5 comprises a tubular body 10 in which a rod 11 is slidable, being actuated by a jacket 12. The rod 11 is provided with two conical closure members 13 and 13' which cooperate with two conical surfaces 14 and 14' with which they can alternately come into substantially sealing contact.

The tubular body 10 and the upper body 15 are coaxially joined by a plurality of ribs 16 which leave between them wide spaces through which the alumina spontaneously flows by gravity when the closure member 13 is in a raised position, so as to refill the tubular body, the capacity of which corresponds to a unitary metered amount of alumina.

Under the action of the jack, the central rod 11 moves the closure member 13 into a down position on the surface 14, while the closure member 13' moves away from its surface 14' and thus permits the metered amount of alumina to flow by way of the distribution spout or chute 6 directly into the opening 7.

The piercing tool 3 is also disposed in a tubular body 17 located within the hopper. It comprises a jack 18, the rod 19 of which is provided at its end with an easily interchangeable piercing bit member 20, and a scraper means 21 which makes it possible to remove the electrolyte crusts which could have adhered to the bit member 20 when it is raised again from the crust.

The control means (not shown) for the jacks 12 and 18 are taken to the outside of the hopper in known manner.

In order to ensure that the bit member 20 does not dip into the bath to no useful purpose, it may be provided with a means for detecting the level of electrolyte, such as an electrical contact means, which gives the jack 18 the order to raise again as soon as the crust has been broken and the end of the bit member has come into contact with the molten electrolyte.

The capacity of the metering means is fixed in dependence on the power of the tank and the number of feed points. A given tank may comprise one or more assemblies comprising metering means, distributors and piercing means, which are distributed for example between the two lines of anodes.

It will be appreciated that this type of metering means is given only by way of example and any other equivalent means for introducing alumina directly into the liquid electrolyte by way of an opening which is kept open, falls within the scope of the invention.

It is also possible for a means for collecting the gaseous effluents which are given off from the crust to be provided in the immediate vicinity of the opening which is formed and maintained in the crust.

Measurement of the internal pseudo-resistance may be effected by different means known to those skilled in the art. The simplest method comprises measuring the current strength I and the voltage U at the terminals of the tank, and performing the operation:

$$R = \frac{U - 1.65}{I}$$

The collected and processed data are finally used for ensuring that the successive metered amounts of alumina are introduced at the appropriate rate.

If for example the normal rate CN is 100 kg per hour, distributed between four introduction openings in the crust, and each metered amount of alumina is 1 kg, CN corresponds to a metered amount every 110 seconds and CL=CN−30% corresponds to a metered amount every 205 seconds.

These calculations and the transmission of orders to the distributor-metering means assembly are effected in known manner by programmable automatic equipment provided with microprocessors.

It is also particularly advantageous for the device for keeping the opening in the crust in an open condition to be provided with a means for detecting blockage of said opening so that, while waiting for the opening to be unblocked manually or automatically, the distributor-metering means assemblies which feed the other openings which have remained open in the crust receive orders to increase their feed rate so that the total amount of alumina introduced into the tank remains constant.

The process and the apparatus described hereinbefore are applied to the series of tanks intended for the production of aluminium by the electrolysis of alumina dissolved in molten cryolite-base baths and more particularly to the situation where the bath comprises:

either from 5 to 13% of $AlF_3$, with an operating temperature of between 955° and 970° C., or from 13 to 20% of $AlF_3$ (baths referred to as 'highly acid'), with an operating temperature of the order of 930° to 955° C., which baths may further contain up to 1% of lithium in the form of lithium fluoride with, in the latter case, an operating temperature which can be down to 910° C.

It is also possible to envisage other additives such as magnesium halides at a level of concentration which can be up to 2% of magnesium or alkali metal or alkaline-earth chlorides, at a level of concentration which may be up to the equivalent of 3% of Cl.

These baths have a relatively low alumina dissolution and absorption capacity and they are accordingly highly suited to carrying out the process according to this invention, which provides a regular introduction of alumina. They have the advantage of providing a level of Faraday efficiency which is markedly higher than the conventional baths which operate at temperatures of from 960° to 970° C.

WORKING EXAMPLE

A series of tanks with prebaked anodes, with a 180000 ampere supply, was operated for several months, with the alumina content being controlled, in accordance with the invention, at around a central value of 2.9%, and with limit variations of 3.5 to 2.1%. The bath contained 13% of $AlF_3$ and the temperature was close to 950° C. The mean Faraday efficiency obtained was 93.5% (instead of an average of 92% with a bath containing 8% of $AlF_3$ and 6 to 9% $Al_2O_3$, at a temperature of 960° C.).

The alumina content was then lowered to a central value of 2.3%, with limit variations of 1.6 and 2.9%. The bath contained 14% of $AlF_3$ and 2% of LiF, and the temperature was close to 935° C. The mean Faraday efficiency obtained was 95%.

It can also be taken as certain that the reduction in temperature, which is achieved by carrying out the present invention, will substantially enhance the service life of electrolysis tanks.

Among the other advantages achieved by using the present invention, reference may be made to eliminating accumulations of sludges on the bottom of the tanks, and a reduction in the mean number of racing phenomena, in each tank, to less than 1 per twenty four hours.

We claim:

1. A process for accurately controlling the rate of introduction and the content of alumina in a tank in the production of aluminum by the electrolysis of dissolved alumina in a molten cryolite-base bath, the upper part of which forms a solidified crust, and wherein the alumina content is maintained in the range between 1% and 3.5% comprising continuously introducing the alumina into the molten cryolite bath through at least one opening which is kept open in the solidified crust, and controlling the rate of introduction of the alumina relative to variations in the internal resistance of the tank measured at equal time intervals, with alternate cycles, of equal and constant duration, of introducing alumina at a slower rate and at a faster rate than the normal feed rate corresponding to the consumption of the tank, said slower rate being 15 to 50% less than said normal rate and said faster being 20 to 100% greater than said normal feed rate.

2. A process according to claim 1 wherein the rate of introduction of alumina is controlled by introducing it in successive amounts, of substantially constant weight, at variable periods of time.

3. A process according to claim 1 wherein each opening for introducing alumina is kept open by means of a plunger which is displaced with a substantially vertical alternating movement and which is actuated in the period of time between the operations of introducing amounts of alumina.

4. A process according to claim 1 wherein at least one of the following additives is added to the bath of molten cryolite:

5 to 20% aluminum fluoride, lithium salts in a concentration equal to or less than 1% expressed in the form of Li, magnesium salts in a concentration equal to or less than 2% expressed in the form of Mg, and alkali metal or alkaline-earth chloride in a concentration equal to or less than 3% expressed in the form of Cl.

5. A process according to claim 1 wherein the temperature of the electrolyte is between 910° and 955° C.

6. A process according to claim 1 for the production of aluminum by electrolysis of dissolved alumina in a molten cryolite-base bath, wherein the alumina content is maintained in a narrow range of between 1 and 3.5% with variations not exceeding ±0.5% with respect to the central value, the cryolite bath having added thereto from 5 to 20% of $AlF_3$ and up to 1% of lithium in the form of LiF, magnesium halides in a concentration up to 2% of magnesium or alkali metal or alkaline earth chlorides in a concentration up to the equivalent of 3% of Cl.

7. A process for accurately controlling the rate of introduction and the content of alumina in a tank in the production of aluminum by the electrolysis of dissolved alumina in a molten cryolite-base bath, the upper part of which forms a solidified crust, and wherein the alumina content is maintained in the range between 1% and 3.5% comprising continuously introducing the alumina into the molten cryolite bath through at least one opening which is kept open in the solidified crust, and controlling the rate of introduction of the alumina relative to variations in the internal resistance of the tank measured at equal time intervals, with alternate cycles, of equal and constant duration, of introducing alumina at a slower rate and at a faster rate than the normal feed rate corresponding to the consumption of the tank, wherein each opening for introducing alumina is kept open by means of a plunger which is displaced with a substantially vertical alternating movement and which is actuated in the period of time between the operations of introducing amounts of alumina, wherein blockage of one of the introduction openings is detected and any introduction of alumina at that point is stopped, and the introduction of alumina at the other openings is proportionately increased until the blocked opening is unblocked.

8. Apparatus for accurately controlling the rate of introduction and content of alumina in a tank in the production of aluminum by the electrolysis of dissolved alumina in a molten cryolite-base bath, comprising means for keeping each loading opening open, means for supplying to each opening successive amounts of alumina, of substantially constant weight, means for measuring the internal pseudo resistance, means for calculating the speed of the variation in internal resistance, means for varying the rate of introduction of the amounts of alumina relative to variations in internal resistance, and means for varying the anode-cathode distance of the tank.

9. Apparatus according to claim 8 further including an effluent collecting means in the vicinity of each opening.

10. Apparatus for accurately controlling the rate of introduction and content of alumina in a tank in the production of aluminum by the electrolysis of dissolved alumina in a molten cryolite-base bath, comprising means for keeping each loading opening open, means for supplying to each opening successive amounts of alumina, of substantially constant weight, means for measuring the internal pseudo resistance, means for calculating the speed of the variation in internal resistance, means for varying the rate of introduction of the amounts of alumina relative to variations in internal resistance, and means for varying the anode-cathode distance of the tank, wherein the apparatus further comprises means for detecting blocking of an introduction opening, means for interrupting the feed at the blocked opening, and means for proportionally accelerating the feed rate at the other openings until the blocked opening is unblocked.

11. The apparatus according to claim 10 further including an effluent collecting means in the vicinity of each opening.

12. Apparatus according to claim 11 wherein the means for delivering successive amounts of alumina, of substantially constant weight, comprises a cylindrical tubular body with a substantially vertical axis, a rod disposed along the axis of the body and at its ends carrying two closure members co-operable with two surfaces on the upper and lower ends of the tubular body, the distance between the two closure members being greater than the length of the tubular body, said rod being connected to a controlled means for producing axial movement upwardly and downwardly and which alternately brings the lower closure member and then the upper closure member into contact with the lower surface and with the upper surface, the upper part of the tubular body communicating with an alumina reservoir, characterised in that the lower part of the tubular body is connected to a passage for a flow of alumina toward the opening in the electrolyte crust.

13. A process for accurately controlling the rate of introduction and content of alumina in a tank in the production of aluminum by the electrolysis of dissolved alumina in a molten cryolite-base bath, the upper part of which forms a solidified crust, and wherein the alumina content is maintained in the range between 1% and 3.5% comprising continuously introducing the alumina into the molten cryolite bath through at least one opening which is kept open in the solidified crust, and controlling the rate of introduction of the alumina relative to variations in the internal resistance of the tank measured at equal time intervals, with alternate cycles, of equal and constant duration, of introducing alumina at a slower rate and at a faster rate than the normal feed rate corresponding to the consumption of the tank, wherein the rate of introduction of alumina relative to variations in the internal resistance of the tank, having an anode and a cathode, is determined according to the following steps:

(a) determining a reference value Ro relative to an internal resistance Ri of the tank, an upper limit Ro+r and a lower limit Ro−r wherein the internal resistance can vary between the upper and lower limits;

(b) beginning a control cycle when Ri is between Ro+r and Ro−r;

(c) introducing alumina into the tank at a slow rate CL which is from 15 to 50% below the normal rate of alumina consumption CN;

(d) measuring successive values of the internal resistance Ri which increases with time;

(e) determining the slope p, relative to the change in Ri as measured by step (d) wherein $p_1$ is compared to a reference value $p^o_1$ and if $p_1 < p^o_1$, decreasing the distance between the anode and cathode and as soon as the internal resistance Ri exceeds Ro+r, increasing the rate of introduction of alumina for a time T to a rapid rate CR which is from 20 to 100% greater than the normal rate of consumption CN;

(f) measuring successive values of the internal resistance Ri which decreases with time;

(g) at time T, stopping the rapid rate CR, determining the slope $p_2$ relative to the change in Ri as measured by step (f) and comparing $p_1$ to $p_2$, wherein if $$\frac{p_2}{p_1} = \frac{CN - CR}{CN - CL}$$

the rates CL and CR do not change, but if $$\frac{p_2}{p_1} \neq \frac{CN - CR}{CN - CL}$$

a second normal rate $CN_1$ is calculated in accordance with the formula $$CN_1 = \frac{p_2 - p_1}{\frac{p_2}{CL} - \frac{p_1}{CR}}$$

and using $CN_1$, determining the slow and rapid rates of the subsequent cycles, and then Ri and Ro−r and $p_2$ and $p_1$ are compared wherein if Ri<Ro−r or $p_2 > p^o_2$, the distance between the anode and cathode are increased and the rate of introduction of alumina is decreased CL, which can be modified depending on the value of the second normal rate $CN_1$, and beginning a new cycle at step (c).

14. A process according to claim 13 wherein at step (e), when the internal resistance Ri of the tank excess the upper limit Ro+r, the following steps are performed:

(h) changing the rate of introduction of alumina to the rapid rate CR for a time To;

(i) measuring successive values of the internal resistance Ri which decreases with time; and (j) at time T, reducing the rate of introduction of alumina to the slow rate CL, and if Ri<Ro−r, increasing the distance between the anode and cathode in relation to (Ro−r)−Ri.

15. A process according to claim 13 wherein at step (e), when the internal resistance Ri of the tank exceeds the upper limit Ro+r, the following steps are performed:

(h) decreasing the distance between the anode and cathode and determining the internal resistance Ri, if Ri is greater than Ro+r, further decreasing the anode-cathode distance repeatedly until Ri is less than Ro+r, when the number of successive steps of decreasing the anode-cathode distance exceeds N, which is from 1 to 5, without the internal resistance Ri decreasing below Ro+r, increasing the rate of introduction of alumina to the rapid rate CR for a time T;

(i) measuring successive values of the internal resistance Ri which decreases with time; and (j) at time T, reducing the rate of introduction of alumina to the slow rate CL, and if Ri<Ro−r, increasing the distance between the anode and cathode in relation to (Ro−r)−Ri and beginning a new cycle at step (c).

16. A process according to claim 13 wherein the slow rate CL is 15 to 50% less than the normal rate CN.

17. A process according to claim 13 wherein the rapid rate CR is 20 to 100% greater than the normal rate CN.

* * * * *